US009847061B2

(12) United States Patent
Takeda

(10) Patent No.: US 9,847,061 B2
(45) Date of Patent: Dec. 19, 2017

(54) ORGANIC EL DISPLAY DEVICE

(71) Applicant: Japan Display Inc, Tokyo (JP)

(72) Inventor: Nobuhiro Takeda, Tokyo (JP)

(73) Assignee: Japan Display Inc., Tokyo (JP)

( * ) Notice: Subject to any disclaimer, the term of this patent is extended or adjusted under 35 U.S.C. 154(b) by 18 days.

(21) Appl. No.: 15/017,785

(22) Filed: Feb. 8, 2016

(65) Prior Publication Data

US 2016/0232851 A1 Aug. 11, 2016

Related U.S. Application Data

(63) Continuation of application No. 14/468,636, filed on Aug. 26, 2014, now Pat. No. 9,293,084.

(30) Foreign Application Priority Data

Aug. 26, 2013 (JP) ..... 2013-174079

(51) Int. Cl.
*G09G 3/32* (2016.01)
*G09G 3/3266* (2016.01)
(Continued)

(52) U.S. Cl.
CPC ..... *G09G 3/3266* (2013.01); *G09G 3/2085* (2013.01); *G09G 3/3233* (2013.01);
(Continued)

(58) Field of Classification Search
CPC .. G09G 3/3266; G09G 3/2085; G09G 3/3233; G09G 3/3258; G09G 3/3241;
(Continued)

(56) References Cited

U.S. PATENT DOCUMENTS 5,206,634 A 4/1993 Matsumoto et al.
5,900,856 A 5/1999 Iino
(Continued)

FOREIGN PATENT DOCUMENTS

JP H02-10398 A 1/1990
JP 2009-169432 A 7/2009
(Continued)

OTHER PUBLICATIONS

Japanese Office Action dated Jun. 6, 2017 for corresponding Japanese Application No. 2013-174079 with partial translation.

*Primary Examiner* — Tom Sheng
(74) *Attorney, Agent, or Firm* — Typha IP LLC

(57) ABSTRACT

An object of the present invention is to, in an organic EL display device in which an initialization voltage is applied, extend the time period usable to write a video voltage as compared with the conventional art. In order to achieve this object, the organic EL display device includes a plurality of pixels each including an organic EL element; a plurality of video lines that supply a video voltage to each of the plurality of pixels; a plurality of scanning lines that supply a scanning voltage to each of the plurality of pixels; a unit that supplies a selection scanning voltage concurrently to an N number of scanning lines among the plurality of scanning lines, and supplies an initialization voltage to each of the plurality of video lines, in a k'th scanning period; and a unit that supplies a selection scanning voltage sequentially to the N number of scanning lines, and supplies video voltages to each of the plurality of video lines, in (k+1)th through (k+N)th scanning periods respectively. N is an integer of 2 or greater (2≤N) and k is any positive integer.

7 Claims, 11 Drawing Sheets

(51) Int. Cl.
*G09G 3/3233* (2016.01)
*G09G 3/20* (2006.01)
*G09G 3/3258* (2016.01)

(52) U.S. Cl.
CPC ... *G09G 3/3258* (2013.01); *G09G 2300/0439* (2013.01); *G09G 2300/0809* (2013.01); *G09G 2300/0861* (2013.01); *G09G 2300/0866* (2013.01); *G09G 2310/0205* (2013.01); *G09G 2310/0243* (2013.01); *G09G 2310/08* (2013.01); *G09G 2320/0233* (2013.01); *G09G 2320/045* (2013.01); *G09G 2330/028* (2013.01); *G09G 2360/12* (2013.01)

(58) Field of Classification Search
CPC ..... G09G 3/325; G09G 2300/0439; G09G 2300/0809; G09G 2300/0861; G09G 2300/0866; G09G 2310/0205; G09G 2310/0243; G09G 2310/08; G09G 2320/0233; G09G 2320/045; G09G 2330/028; G09G 2360/12
See application file for complete search history.

(56) References Cited

U.S. PATENT DOCUMENTS 6,239,779 B1 5/2001 Furuya
6,504,520 B1 1/2003 Osada et al.
6,657,610 B1 12/2003 Baba
8,232,986 B2 * 7/2012 Kim ..... G09G 3/3233 345/211
8,305,307 B2 * 11/2012 Ono ..... G09G 3/3233 345/76
8,797,240 B2 * 8/2014 Kishi ..... G09G 3/3233 345/76
2001/0050662 A1 12/2001 Kota et al.
2002/0044782 A1 4/2002 Kota et al.
2004/0179031 A1 9/2004 Ando
2007/0085791 A1 4/2007 Tseng
2007/0268210 A1 * 11/2007 Uchino ..... G09G 3/3233 345/55
2008/0284776 A1 11/2008 Hirayama
2009/0109146 A1 * 4/2009 Minami ..... G09G 3/3233 345/76
2009/0135111 A1 * 5/2009 Yamamoto ..... G09G 3/3233 345/76
2009/0244055 A1 10/2009 Asano et al.
2010/0007645 A1 * 1/2010 Ono ..... G09G 3/3233 345/211
2010/0085492 A1 4/2010 Shiomi
2010/0103205 A1 4/2010 Iisaka et al.
2011/0267323 A1 * 11/2011 Fujikawa ..... G09G 3/3648 345/206
2011/0292014 A1 12/2011 Hwang
2011/0316892 A1 * 12/2011 Sung ..... G09G 3/3233 345/690
2012/0019499 A1 1/2012 Hwang et al.
2012/0019505 A1 1/2012 Hwang
2012/0038834 A1 2/2012 Kitayama et al.
2013/0106823 A1 * 5/2013 Kishi ..... G09G 3/3258 345/211
2013/0181969 A1 * 7/2013 Kishi ..... G09G 3/3233 345/212
2014/0085347 A1 3/2014 Yatabe
2015/0145842 A1 5/2015 Maeda et al.

FOREIGN PATENT DOCUMENTS

JP 2009-237041 A 10/2009
WO 2012/053462 A1 4/2012

* cited by examiner

Fig.10

| | Difference in invalid period from immediately subsequent | | | | | |
|---|---|---|---|---|---|---|
| Dispersion Pattern 1 | Scanning line \ Frame | M | M+1 | M+2 | M+3 | Standard deviation 0.894 |
| | k | 3 | 1 | 1 | 1 | |
| | k+1 | 1 | 3 | 1 | 1 | |
| | k+2 | 1 | 1 | 3 | 1 | |
| | k+3 | 1 | 1 | 1 | 3 | |
| Dispersion Pattern 2 | Scanning line \ Frame | M | M+1 | M+2 | M+3 | Standard deviation 0.683 |
| | k | 3 | 2 | 1 | 2 | |
| | k+1 | 1 | 2 | 1 | 2 | |
| | k+2 | 1 | 2 | 1 | 2 | |
| | k+3 | 1 | 2 | 3 | 2 | |
| Dispersion Pattern 3 | Scanning line \ Frame | M | M+1 | M+2 | M+3 | Standard deviation 0.683 |
| | k | 2 | 1 | 2 | 1 | |
| | k+1 | 2 | 3 | 2 | 1 | |
| | k+2 | 2 | 1 | 2 | 1 | |
| | k+3 | 2 | 1 | 2 | 3 | |
| Dispersion Pattern 4 | Scanning line \ Frame | M | M+1 | M+2 | M+3 | Standard deviation 0.683 |
| | k | 2 | 1 | 2 | 3 | |
| | k+1 | 2 | 1 | 2 | 1 | |
| | k+2 | 2 | 3 | 2 | 1 | |
| | k+3 | 2 | 1 | 2 | 1 | |
| Dispersion Pattern 5 | Scanning line \ Frame | M | M+1 | M+2 | M+3 | Standard deviation 0.683 |
| | k | 1 | 2 | 1 | 2 | |
| | k+1 | 1 | 2 | 3 | 2 | |
| | k+2 | 1 | 2 | 1 | 2 | |
| | k+3 | 3 | 2 | 1 | 2 | |
| Dispersion Pattern 6 | Scanning line \ Frame | M | M+1 | M+2 | M+3 | Standard deviation 0.894 |
| | k | 1 | 1 | 1 | 3 | |
| | k+1 | 1 | 1 | 3 | 1 | |
| | k+2 | 1 | 3 | 1 | 1 | |
| | k+3 | 3 | 1 | 1 | 1 | |

ORGANIC EL DISPLAY DEVICE

CROSS REFERENCE TO RELATED APPLICATIONS

This application is a continuation of U.S. patent application Ser. No. 14/468,636, filed on 26th Aug. 2014, which, in turn, is based up and claims the benefit of priority from the prior Japanese Patent Application No. 2013-174079, filed on 26th Aug. 2013, the entire contents of which are incorporated herein by reference.

FIELD

The present invention relates to an organic EL display device, and specifically to a technology effective to compensate for a threshold voltage of a driving transistor of a pixel circuit.

BACKGROUND

Recently, there has been an increasing demand for flat panel display (FPD) devices. Especially, organic EL display devices using an organic EL (Electro Luminescence) element (OLED; Organic Light Emitting Diode) are excellent in power consumption, lightweightedness, thinness, moving image characteristics, viewing angle and the like, and are now being progressively developed and put into practice. An organic EL display device includes a pixel circuit including a driving transistor. The driving transistor of the pixel circuit controls a driving current flowing in an organic EL element in accordance with a video voltage that is in accordance with a video data that is input to a gate electrode of the pixel circuit, and thus controls the gray scale of an image to be displayed. In general, a driving transistor is a polysilicon thin film transistor that uses polysilicon (polycrystalline silicon) for a semiconductor film. Regarding such a polysilicon thin film transistor, it is known that the variance in the threshold voltage is large or that the threshold voltage varies along with time. Therefore, an organic EL display device in which the gray scale is controlled by use of the video voltage in accordance with the video data has a problem that the variance in the threshold voltage of the driving transistor or the change in the threshold value along with time changes the value of the current flowing in the organic EL element, which causes a variance in the luminance. Patent Document 1 (Japanese Laid-Open Patent Publication No. 2009-169432) describes that in order to solve the above-described problems, the value of the current flowing in the organic EL element in each of pixels is detected, and a predetermined offset voltage is applied based on the detected value to correct the threshold voltage.

According to a conventionally known driving method used to compensate for the threshold voltage of a driving transistor as described above, an initialization voltage and a video voltage are applied alternately. When this technique is used, the time period which can be used to write a video voltage to each of pixels is shortened to about half. In the case of a square structure including red (R), green (G), blue (B) and white (W) pixels, the time period usable to write a video voltage to each of the pixels is further shortened to half. The time period usable to write a video voltage to each of the pixels is also shortened when the number of scanning lines is increased in order to realize high definition display.

In order to write a video voltage to each pixel within a short time period, the resistance and the capacitance of video (source) lines or the like need to be reduced. However, this is difficult because the width of the lines is decreased and the number of intersections of the lines is increased in order to realize high definition display.

SUMMARY

According to an embodiment of the present invention, an organic EL display device includes a plurality of pixels each including an organic EL element; a plurality of video lines that supply a video voltage to each of the plurality of pixels; and a plurality of scanning lines that supply a scanning voltage to each of the plurality of pixels; a video line driving circuit connected to the plurality of video lines; and a scanning line driving circuit connected to the plurality of scanning lines. Where N is an integer of 2 or greater ($2 \leq N$) and k is any positive integer, the scanning line driving circuit supplies a selection scanning voltage concurrently to an N number of scanning lines among the plurality of scanning lines in a k'th scanning period, and supplies a selection scanning voltage sequentially to the N number of scanning lines in (k+1)th through (k+N)th scanning periods respectively; and the video line driving circuit supplies an initialization voltage to each of the plurality of video lines in the k'th scanning period, and supplies video voltages to each of the plurality of video lines in the (k+1)th through (k+N)th scanning periods respectively.

The k'th scanning period may be different between two continuous frames. In first through N'th frames that are continuous, the k'th scanning periods are respectively (k1)th through (kN)th scanning periods; and values of k1 through kN may not monotonically increase or decrease. In the case that in first through N'th frames that are continuous, the k'th scanning periods are respectively (k1)th through (kN)th scanning periods, and j is any integer among 1 through (N−2), the k'th scanning periods may meet the following formula.

$$|k(j+1)-kj| \neq |k(j+1)-k(j+2)|$$

Each of the plurality of pixels may include a pixel circuit; and the pixel circuit may include a driving transistor connected between the organic EL element and a power line; a capacitance element connected between a gate electrode of the driving transistor and a connection point between the organic EL element and the driving transistor; and a switching transistor that is connected between the gate electrode of the driving transistor and the corresponding video line among the plurality of video lines, and has a gate electrode thereof connected to the corresponding scanning line among the plurality of scanning lines.

BRIEF EXPLANATION OF DRAWINGS

FIG. 10 shows the difference in the invalid display time period of each of four frames from that of the immediately subsequent frame in the case where the timing at which the initialization voltage (Vini) is inserted is varied among the four frames and there are six different patterns of the order of such timings.

DESCRIPTION OF EMBODIMENTS

The present invention made to solve the above-described problems of the conventional art has an object of providing a technology that, in an organic EL display device in which an initialization voltage is applied, is capable of extending the time period usable to write a video voltage as compared with the conventional art. The above-described and other objects and novel features of the present invention will be made apparent by the description of this specification and the attached drawings.

Hereinafter, an embodiment of the present invention will be described in detail with reference to the drawings. Throughout the drawings showing the embodiment, elements having the same functions will bear the same reference numbers, and the same descriptions thereof will not be repeated. The embodiment described below is merely an example, and the present invention is not limited to the embodiment.

Figure 1:
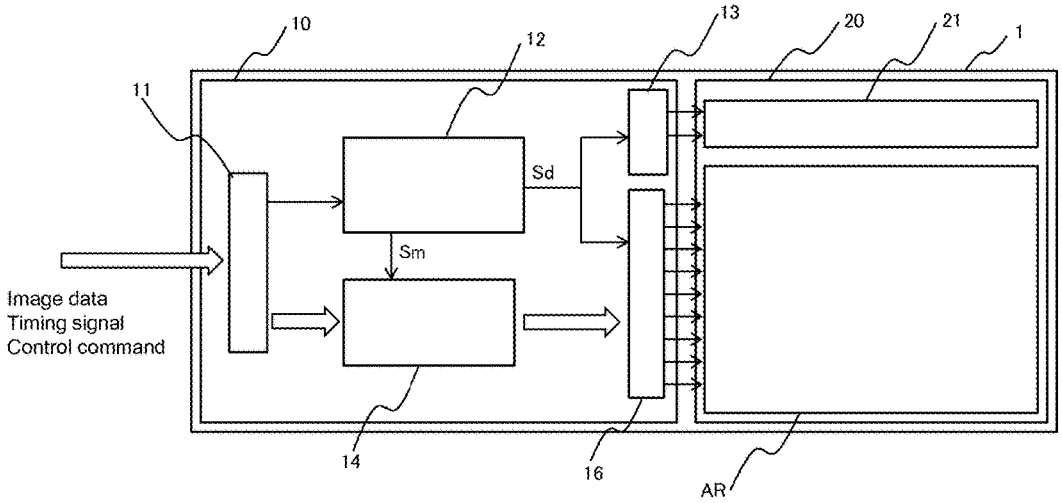
FIG. 1 is a block diagram showing a schematic structure of an organic EL display device in an embodiment according to the present invention.

FIG. 1 is a block diagram showing a schematic structure of an organic EL display device in an embodiment according to the present invention. In FIG. 1, reference number 1 represents the organic EL display device. The organic EL display device 1 includes an organic EL driving circuit 10 and an organic EL display panel 20. The organic EL display panel 20 includes video lines (not shown), scanning lines (not shown), and a scanning line driving circuit 21. The organic EL driving circuit 10 includes an interface circuit 11 to which video data, timing signals and control commands are input from an external image processing circuit (not shown), a control signal generation circuit 12 that generates a driving signal, a scanning line control circuit 13, a frame memory 14 that stores video data input from external device, and a video signal output circuit 16.

The control signal generation circuit 12 generates a memory control signal (Sm) usable to control the frame memory 14, and a driving control signal (Sd) usable to control the scanning line control circuit 13 and the video signal output circuit 16, based on a timing signal and a control command input from the external image processing circuit via the interface circuit 11. The scanning line control circuit 13 controls the scanning line driving circuit 21 based on the driving control signal (Sd) input from the control signal generation circuit 12. The scanning line driving circuit 21 supplies a selection scanning voltage, usable to write a video voltage to each of pixels, sequentially to the scanning lines in the organic EL display panel 20 in one frame based on a scanning line scan start signal that is input from the scanning line control circuit 13. The video data that is input from the external image processing circuit via the interface circuit 11 is input to the frame memory 14. The video data that is read from the frame memory 14 is input to the video signal output circuit 16. The video signal output circuit 16 converts the video data into an analog video voltage and outputs the analog video voltage to the video lines in the organic EL display panel 20 based on a video voltage output timing signal that is input from the control signal generation circuit 12. In this manner, an image is displayed in a display area AR of the organic EL display panel 20.

Figure 2:
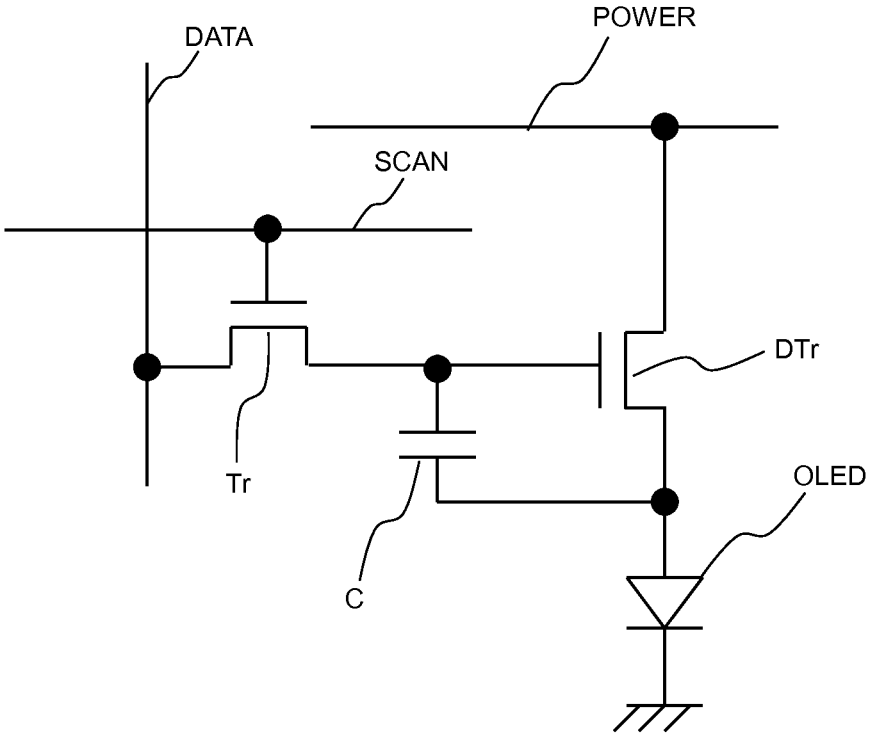
FIG. 2 is a circuit diagram showing a circuit configuration of a pixel circuit of the organic EL display device in the embodiment according to the present invention.

FIG. 2 is a circuit diagram showing a circuit configuration of a pixel circuit of the organic EL display device in an example of the present invention. In FIG. 2, "OLED" represents an organic EL element. An anode electrode of the organic EL element (OLED) is connected to a power line (POWER) via a driving transistor (DTr), and a cathode electrode of the organic EL element (OLED) is grounded. A storage capacitance (C) is connected between a gate electrode and a source electrode (or a drain electrode) of the driving transistor (DTr). The gate electrode of the driving transistor (DTr) is connected to a video line (data) via a switching transistor (Tr). A gate electrode of the switching transistor (Tr) is connected to a scanning line (SCAN). The driving transistor (DTr) and the switching transistor (Tr) are formed by use of a polysilicon thin film.

Figure 3:
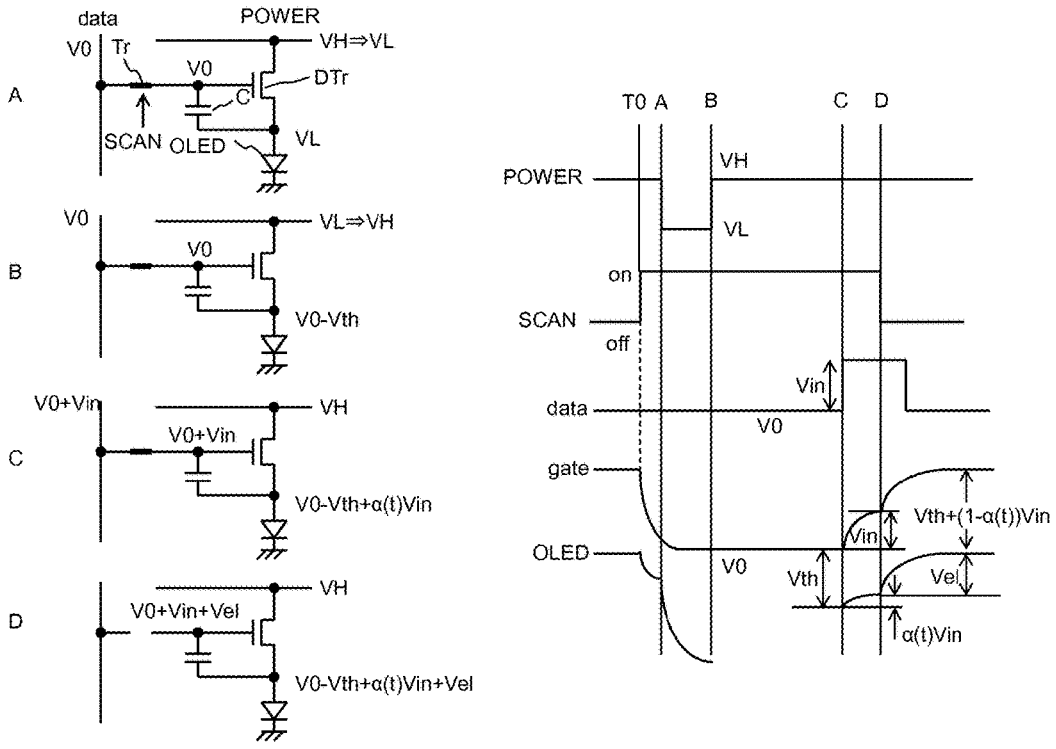
FIG. 3 shows a conventional method for driving the pixel circuit shown in FIG. 2.

FIG. 3 shows a conventional method for driving the pixel circuit shown in FIG. 2. At time (T0), a selection scanning voltage is supplied to the scanning line (SCAN). As a result, the voltage on the scanning line (SCAN) becomes a VH voltage of a High level (hereinafter, referred to as an "H level"), and the switching transistor (Tr) is put into an ON state. At this point, an initialization voltage V0 has been applied to the video line (data). In FIG. 3, the switching transistor (Tr) in the ON state is represented with a thick line. At time (A), the voltage on the power line (POWER) becomes a VL voltage of a Low level (hereinafter, referred to as an "L level") from a VH voltage of an H level. As a result, the video voltage, which was input to the gate electrode of the driving transistor (DTr) in the immediately previous cycle of scanning, is reset. In addition, V0>VL. Therefore, the organic EL element (OLED) is put into an OFF state, and the anode electrode of the organic EL element (OLED) becomes a VL voltage. At time (B), the voltage on the power line (POWER) becomes a VH voltage of an H level from the VL voltage of the L level. At this point, the anode electrode of the organic EL element (OLED) obtains a voltage (V0−Vth). Herein, "Vth" is a threshold voltage of the driving transistor (DTr). Therefore, as seen from the anode electrode of the organic EL element (OLED) (the source electrode (or the drain electrode) of the driving transistor (DTr)), the gate electrode of the driving transistor (DTr) is set to a voltage Vth.

At time (C), the voltage on the video line (data) becomes a voltage (V0+Vin). When this occurs, the anode electrode of the organic EL element (OLED) obtains a voltage (V0−Vth+$\alpha$(t)Vin). Herein, "Vin" is a video voltage in the current cycle of scanning. At time (D), a non-selection scanning voltage is supplied to the scanning line (SCAN). As a result, the voltage on the scanning line (SCAN) becomes a VL voltage of an L level, and the switching transistor (Tr) is put into an OFF state. At this point, a voltage (Vth+(1−α(t))Vin) is held in the storage capacitance (C). In this manner, the driving method shown in FIG. 3 CaO compensate for the threshold voltage of the driving transistor (DTr). In FIG. 3, the switching transistor (Tr) in the OFF state is represented with the absence of the thick line. In FIG. 3, "α(t)Vin" represents a voltage that is generated by a current flowing in the organic EL element (OLED) as a result of application of the voltage (V0+Vin) to the gate electrode of the driving transistor (DTr). "Vel" represents a voltage that is generated by the current flowing in the organic EL element (OLED) in the state where the voltage (Vth+(1−α(t))Vin) is held in the storage capacitance (C).

Figure 11:
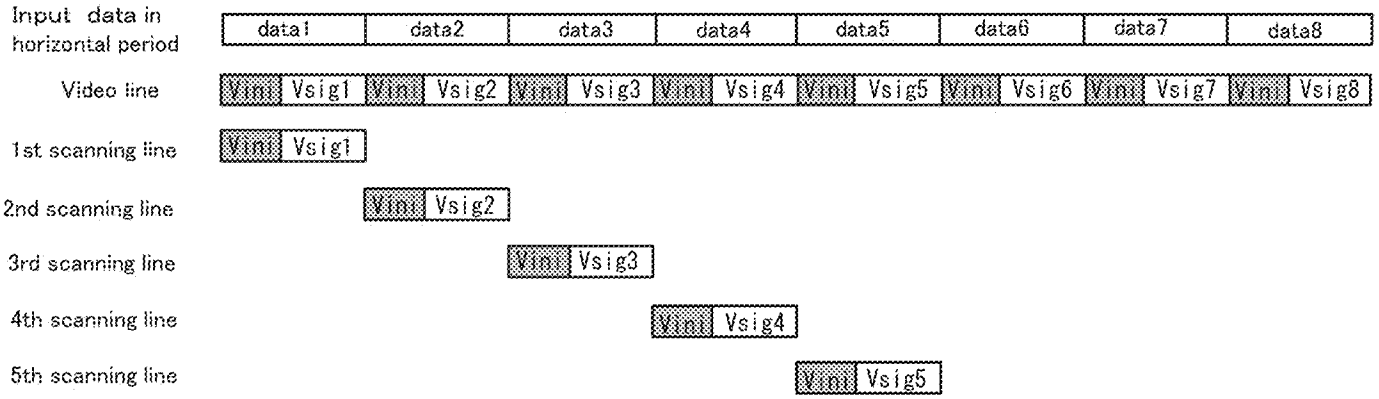
FIG. 11 shows a conventional method for driving an organic EL display device.

FIG. 11 shows a conventional method for driving an organic EL display device. The conventional method is performed as described below with reference to FIG. 11. The video signal output circuit 16 converts input data (data1 through data8) input from an external device into analog video voltages (Vsig1 through Vsig8), and then inserts an initialization voltage (Vini) before each of the video voltages and outputs the resultant video voltages to the video line (data) in scanning periods of the respective scanning lines. Then, in conformity to the above-described driving method shown in FIG. 3, the threshold voltage of the driving transistor (DTr) is compensated for, and thus the organic EL element (OLED) is lit up. In this manner, according to the conventional method for driving the organic EL display device, a selection scanning voltage is sequentially supplied to the scanning lines, while an initialization voltage (Vini) and a video voltage (signal) are alternately supplied to the video line in the respective scanning periods. Thus, the threshold voltage of the driving transistor (DTr) is corrected, so that the organic EL element (OLED) is lit up. However, with the conventional method for driving the organic EL display device, the time period usable to apply a video voltage to the organic EL element in each pixel is shortened to about half. In the case of a square structure including red (R), green (G), blue (B) and white (W) pixels, the time period usable to apply a video voltage is further shortened to half. The time period usable to apply a video voltage is also shortened when the number of the scanning lines is increased in order to realize high definition display.

Figure 4:
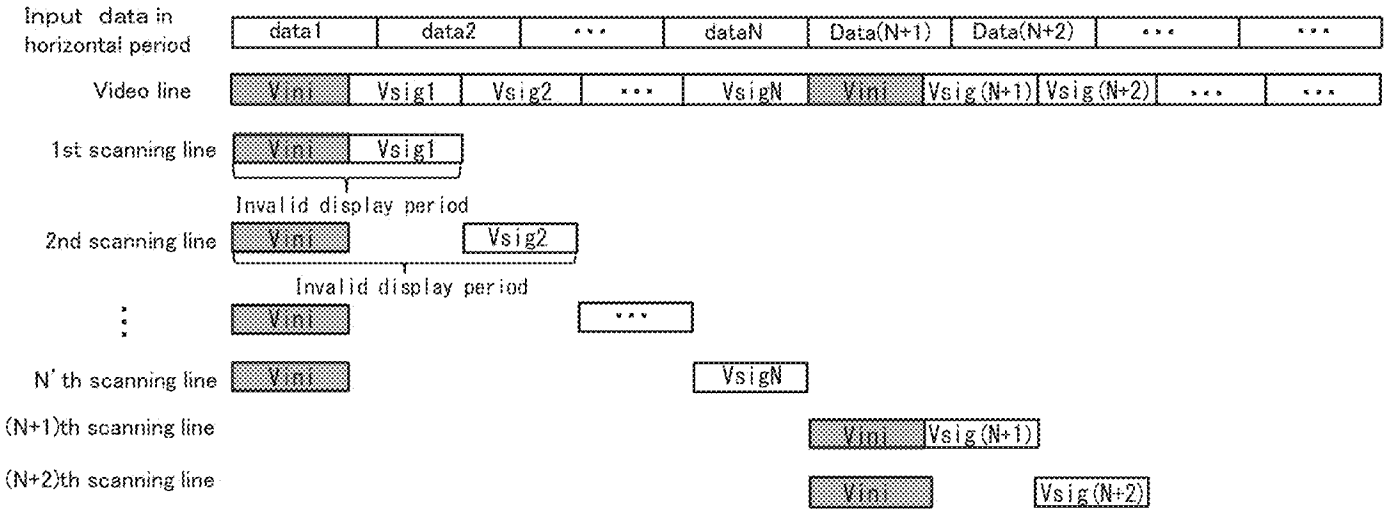
FIG. 4 shows a method for driving the organic EL display device in the embodiment according to the present invention.

FIG. 4 shows a method for driving an organic EL display device in an embodiment according to the present invention. In this embodiment, video data (data1 through data (N+2) . . . ) input from an external device is stored on the frame memory 14. Video data of an N number of horizontal periods (or N number of scanning periods) is read from the frame memory 14 and converted into N number of analog video voltages (Vsig1 through VsigN). "N" is an integer of 2 or greater (2≤N). The video signal output circuit 16 inserts an initialization voltage (Vini) before each of the N number of analog voltages (Vsig1 through VsigN) and supplies the video line (data) with the voltages in the order of the initialization voltage (Vini)→the video signal (Vsig1)→the video signal (Vsig2) . . . →the video signal (VsigN) in the first through (N+1)th scanning periods. The scanning line driving circuit 21 supplies a selection scanning voltage to the first through N'th scanning lines (SCAN) in the first scanning period. Since the video line (data) is supplied with the initialization voltage (Vini) in the first scanning period, the threshold voltages of the driving transistors (DTr) of the pixels including the switching transistors (Tr) having the gate electrodes thereof connected to the first through N'th scanning lines, namely, N number of scanning lines, are compensated for concurrently. The scanning line driving circuit 21 supplies a selection scanning voltage to the first scanning line (SCAN) in the second scanning period. In the second scanning period, the video line (data) is supplied with the video voltage (Vsig1), and therefore the video voltage (Vsig1) is written to the pixels including the switching transistors (Tr) having the gate electrodes thereof connected to the first scanning line.

The scanning line driving circuit 21 supplies a selection scanning voltage to the second scanning line (SCAN) in the third scanning period. In the third scanning period, the video line (data) is supplied with the video voltage (Vsig2), and therefore the video voltage (Vsig2) is written to the pixels including the switching transistors (Tr) having the gate electrodes thereof connected to the second scanning line. After this, in a similar manner, the scanning line driving circuit 21 supplies a selection scanning voltage to the N'th scanning line (SCAN) in the (N+1)th scanning period. In the (N+1)th scanning period, the video line (data) is supplied with the video voltage (VsigN), and therefore the video voltage (VsigN) is written to the pixels including the switching transistors (Tr) having the gate electrodes thereof connected to the N'th scanning line. After this, the N number of analog video voltages (Vsig(N+1) through Vsig2N) are also written to the corresponding pixels in the manner described above. As described so far, in this embodiment, it is made possible to extend the time period usable to write a video signal (Vsig) to each pixel or a time period usable to apply the initialization voltage (Vini) to each pixel. In the case where the number (N) of the scanning lines (SCAN) which are initialized at the same time is increased, the time period usable to write a video voltage to each pixel can be extended, but the required memory capacity of the frame memory 14 is also increased. In addition, as shown in FIG. 4, the time period required after the initialization voltage is applied to each pixel until the video voltage is written to each pixel (invalid display time period) is different among the N number of scanning lines. This causes a luminance difference.

Figure 5:
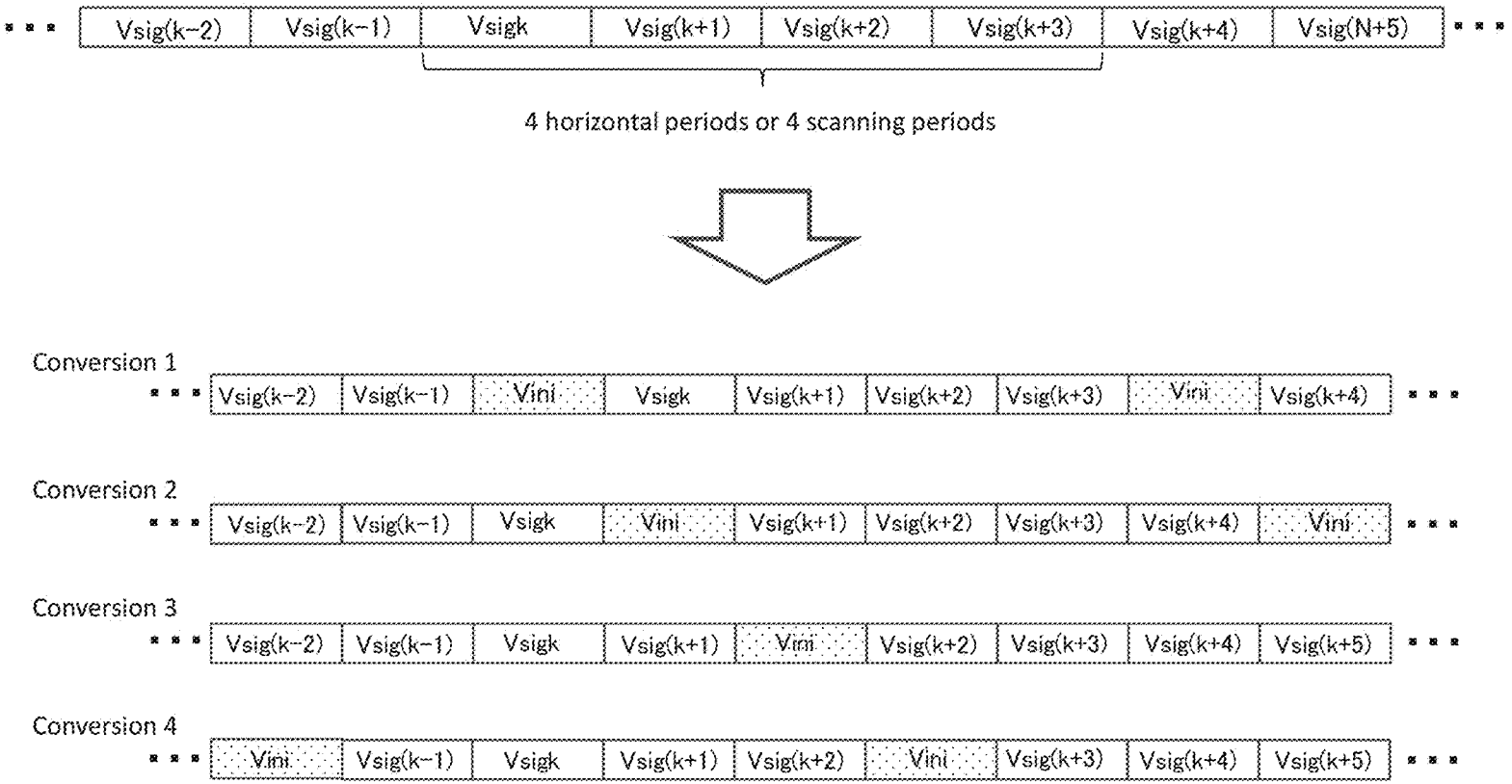
FIG. 5 shows the timing at which an initialization voltage (Vini) is inserted in each frame in the organic EL display device in the embodiment according to the present invention.
Figure 6:
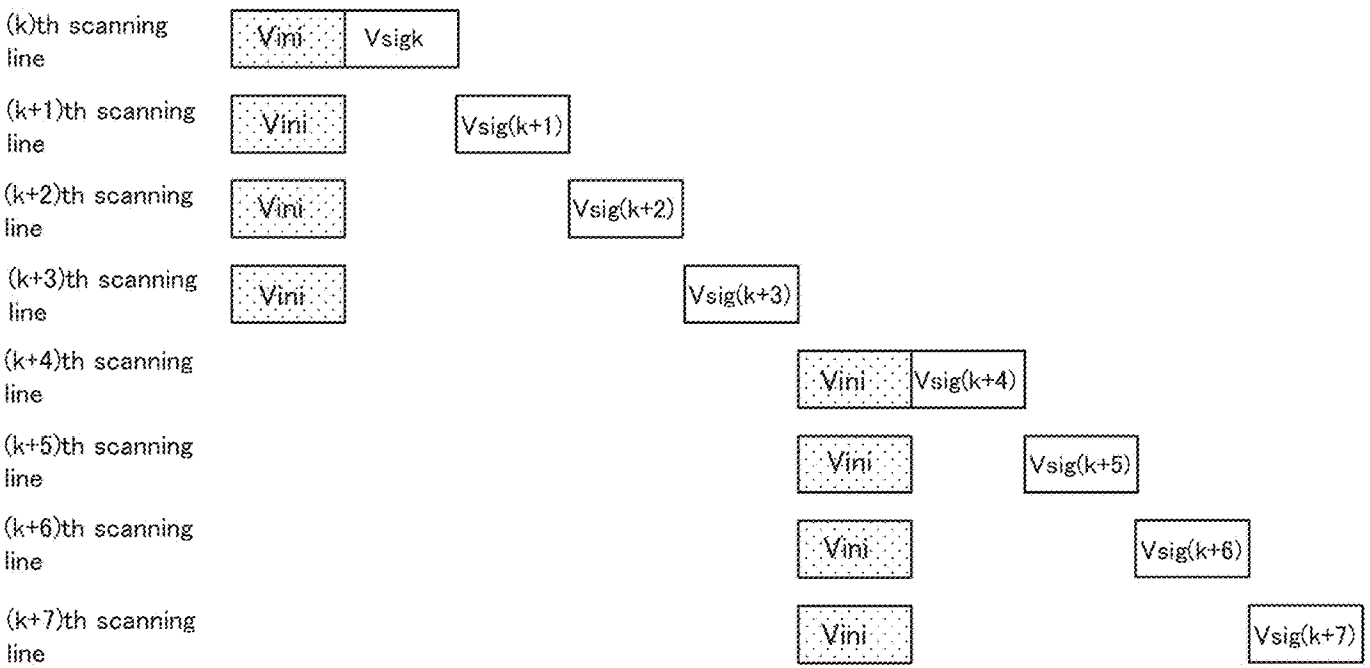
FIG. 6 shows a time period required after the initialization voltage is applied to each of pixels until a video voltage is written to each pixel (invalid display time period) in the case of conversion 1 shown in FIG. 5.
Figure 7:
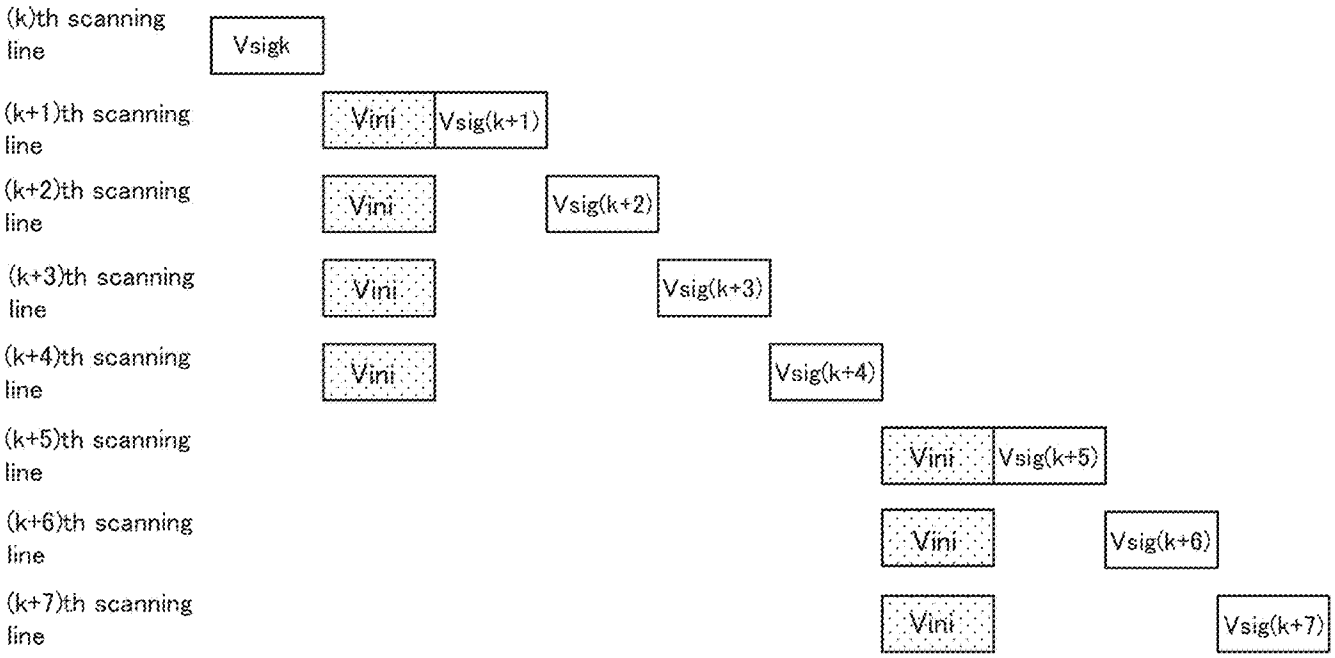
FIG. 7 shows a time period required after the initialization voltage is applied to each pixel until a video voltage is written to each pixel (invalid display time period) in the case of conversion 2 shown in FIG. 5.
Figure 8:
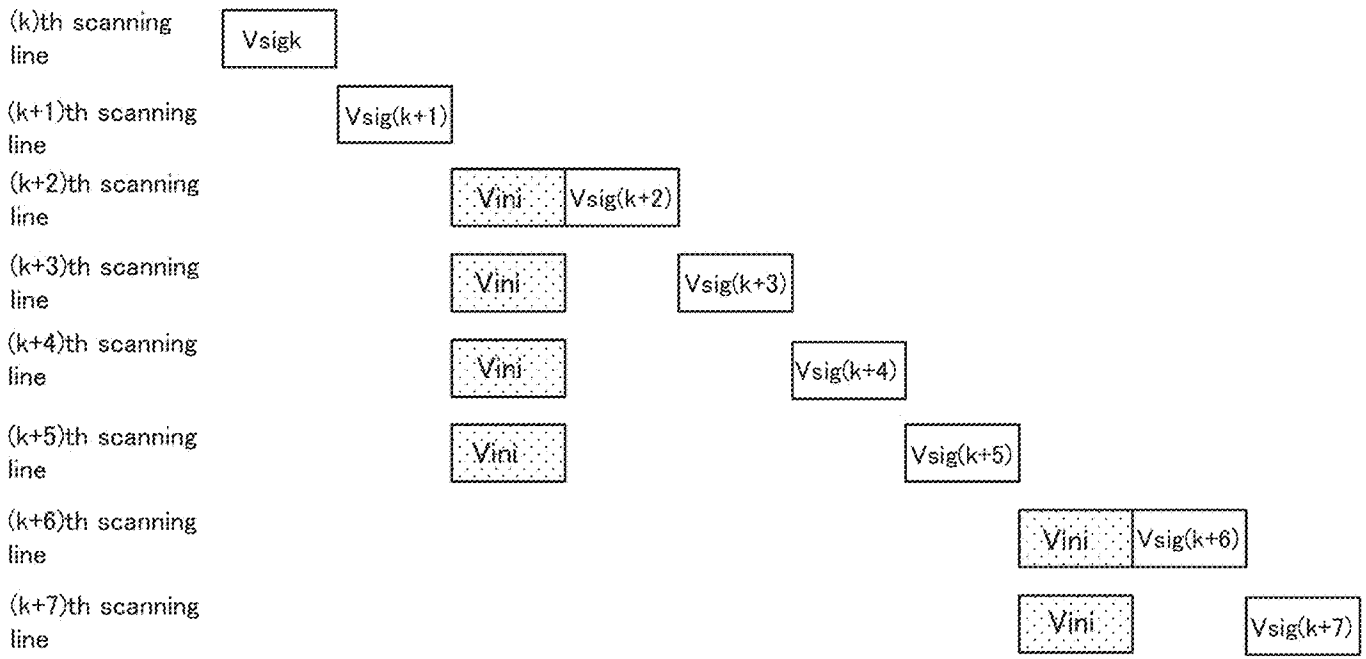
FIG. 8 shows a time period required after the initialization voltage is applied to each pixel until a video voltage is written to each pixel (invalid display time period) in the case of conversion 3 shown in FIG. 5.
Figure 9:
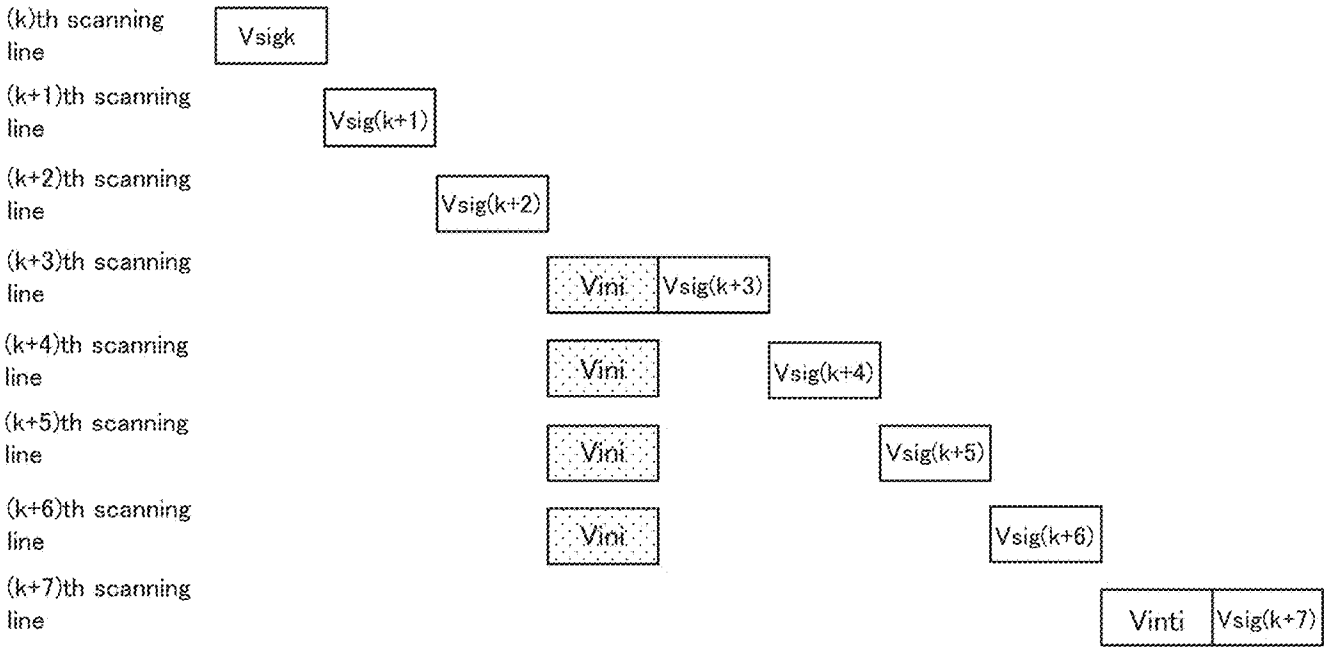
FIG. 9 shows a time period required after the initialization voltage is applied to each pixel until a video voltage is written to each pixel (invalid display time period) in the case of conversion 4 shown in FIG. 5.

In this embodiment, in order to avoid these problems, the timing at which the initialization voltage (Vini) is inserted is varied at every M'th or (M+N)th frame, such that the invalid display time period is made equal among the scanning lines (SCAN). "M" is any integer. FIG. 5 shows the timing at which the initialization voltage (Vini) is inserted for each frame in the organic EL display device in an embodiment according to the present invention. In FIG. 5, the number of the scanning lines (SCAN) which are supplied with the initialization voltage (Vini) at the same time is 4, and the timing at which the initialization voltage (Vini) is inserted is varied frame by frame. In FIG. 5, "k" is any number that is an integral multiple of 4. Conversion 1 is an example in which the initialization voltage (Vini) is inserted before the video voltages (Vsig(k) through Vsig(k+3)). FIG. 6 shows the time periods required from when the initialization voltage (Vini) is applied to each pixel until the video voltages (Vsig(k) through Vsig(k+3)) are written to the corresponding pixels (invalid display time periods) in the case of conversion 1 in FIG. 5. Returning to FIG. 5, conversion 2 is an example in which the initialization voltage (Vini) is inserted before the video voltages (Vsig(k+1) through Vsig (k+4)). FIG. 7 shows the time periods required from when the initialization voltage (Vini) is applied to each pixel until the video voltages (Vsig(k+1) through Vsig(k+4)) are written to the corresponding pixels (invalid display time periods) in the case of conversion 2 in FIG. 5. Returning to FIG. 5, conversion 3 is an example in which the initialization voltage (Vini) is inserted before the video voltages (Vsig (k+2) through Vsig(k+5)). FIG. 8 shows the time periods required from when the initialization voltage (Vini) is applied to each pixel until the video voltages (Vsig(k+2) through Vsig(k+5)) are written to the corresponding pixels (invalid display time periods) in the case of conversion 3 in FIG. 5. Returning to FIG. 5, conversion 4 is an example in which the initialization voltage (Vini) is inserted before the video voltages (Vsig(k−1) through Vsig(k+2)). FIG. 9 shows the time periods required from when the initialization voltage (Vini) is applied to each pixel until the video voltages (Vsig(k−1) through Vsig(k+2)) are written to the corresponding pixels (invalid display time periods) in the case of conversion 4 in FIG. 5.

In the case where the timing at which the initialization voltage (Vini) is inserted is varied among four frames of the (M)th through (M+3)th frames, the order of conversions 1 through 4 shown in FIG. 5 may be varied in six different patterns, namely, dispersion patterns 1 through 6, as shown in FIG. 10. In dispersion pattern 1, the conversion timing is changed from conversion 1→conversion 2→conversion 3→conversion 4. In dispersion pattern 2, the conversion timing is changed from conversion 1→conversion 2→conversion 4→conversion 3. In dispersion pattern 3, the conversion timing is changed from conversion 1→conversion 3→conversion 2→conversion 4. In dispersion pattern 4, the conversion timing is changed from conversion 1→conversion 3→conversion 4→conversion 2. In dispersion pattern 5, the conversion timing is changed from conversion 1→conversion 4→conversion conversion 3. In dispersion pattern 6, the conversion timing is changed from conversion 1→conversion 4→conversion 3→conversion 2.

FIG. 10 shows the difference in the invalid display time period of each of the four frames ((M)th through (M+3)th frames) from that of the immediately subsequent frame in the case where the timing at which the initialization voltage (Vini) is inserted is varied among the four frames of the (M)th through (M+3)th frames and there are six different patterns of the order of such timings. Such a difference is shown for each of the (K)th through (K+3)th scanning lines. The difference in the invalid display time period between two adjacent frames is recognized as flicker, which deteriorates the display quality. The difference in the valid display time period between two adjacent frames is large in dispersion patterns 1 and 6. In dispersion pattern 1, the conversion timing is changed from conversion 1→conversion 2→conversion 3→conversion 4. In this manner, in dispersion pattern 1, the conversion numbers increase monotonically. In dispersion pattern 6, the conversion timing is changed from conversion 1→conversion 4→conversion 3→conversion 2. In this manner, in dispersion pattern 6, the conversion numbers decrease monotonically. As the patterns of the order of timings at which the initialization voltage (Vini) is inserted in each of four frames, dispersions patterns 2 through 5 shown in FIG. 10 are effective. In dispersion patterns 2 through 5, where the k'th scanning periods in the four continuous frames are respectively k1 through k4, the k'th scanning periods meet the following formula (1).

$$|k(j+1)-kj| \neq |k(j+1)-k(j+2)| (j=1,2) \quad (1)$$

This can be generalized as follows. In thH case where the k'th scanning periods in continuous first through N'th frames are the (k1)th through (kN)th scanning periods and j is an integer of 1 through (N−2), it is preferable that the k'th scanning periods meet the following formula (2).

$$|k(j+1)-kj| \neq |k(j+1)-k(j+2)| \quad (2)$$

In this embodiment, in the case where the initialization voltage (Vini) is of a black display level so that the ratio of the invalid display time period is high, impulse display is provided and thus the moving image performance can be improved.

As described above, according to the present invention, in an organic EL display device in which an initialization voltage is applied, the time period usable to write a video signal can be extended as compared with the conventional art. The invention made by the present inventor has been specifically described by way of the above embodiment. The present invention is not limited to the above-described embodiment and may be modified in various manners without departing from the gist thereof.

What is claimed is:

1. A display device comprising:

a plurality of pixels arranged in a matrix;

a plurality of scanning lines arranged in a row direction;

a plurality of video lines arranged in a column direction and configured to be input with an initialization signal or a video signal; and a plurality of power lines configured to be input with an initialization voltage or a driving voltage, the plurality of scanning lines includes a first group of scanning lines, each of the plurality of pixels includes:

a first transistor electrically connected to one of the plurality of video lines and configured to be controlled by one of the plurality of scanning lines; and a second transistor electrically connected to one of the plurality of power lines, wherein the initialization signal and the video signal are input to the gate of the second transistor through the first transistor, the first group of scanning lines are selected concurrently, the initialization signal is input to the plurality of video lines concurrently, and the initialization voltage is input to the plurality of power lines concurrently in an initializing period, each of the scanning lines of the first group of scanning lines is selected sequentially, the video signals corresponding to each row are input to the plurality of video lines sequentially, and the driving voltage is input to the plurality of power lines concurrently in a writing period, at least one of the scanning lines included in the first group of scanning lines in a first frame period is not included in the first group of scanning lines in a second frame period next to the first frame period, and another one of the scanning lines is included in the first group of scanning lines during three continuous frame periods that include the first frame period and the second frame period.

2. The display device according to claim 1, wherein at least one of the scanning lines not included in the first group of scanning lines in the first frame period is included in the first group of scanning lines in the second frame period.

3. The display device according to claim 1, wherein the plurality of scanning lines further includes a second group of scanning lines, the initializing period and the writing period are executed in the second group of scanning lines after the initializing period and the writing period are executed in the first group of scanning lines.

4. The display device according to claim 1, wherein a sequence of video signals input to the plurality of video lines at the first frame period is the same as a sequence of video signals input to the plurality of video lines at the second frame period.

5. A display device comprising:

a plurality of pixels arranged in a matrix;

a plurality of scanning lines arranged in a row direction;

a plurality of video lines arranged in a column direction and configured to be input with an initialization signal or a video signal; and a plurality of power lines configured to be input with an initialization voltage or a driving voltage, the plurality of scanning lines includes a first group of scanning lines and a second group of scanning lines next to the first group of scanning lines, each of the plurality of pixels includes:

a first transistor electrically connected to one of the plurality of video lines and configured to be controlled by one of the plurality of scanning lines; and a second transistor electrically connected to one of the plurality of power lines, wherein the initialization signal and the video signal are input to the gate of the second transistor through the first transistor, each of the first group of scanning lines and the second group of scanning lines has an initializing period and a writing period, all of the scanning lines included in the first group of scanning lines or the second group of scanning lines are selected concurrently in the initializing period, each of the scanning lines included in the first group of scanning lines or the second group of scanning lines are selected sequentially in the writing period, at least one of the scanning lines included in the first group of scanning lines in a first frame period is included in the second group of the scanning lines in a second frame period next to the first frame period, and another one of the scanning lines is included in the first group of scanning lines during three continuous frame periods that include the first frame period and the second frame period.

6. The display device according to claim 5, wherein the initializing period and the writing period are executed in the second group of scanning lines after the initializing period and the writing period are executed in the first group of scanning lines.

7. The display device according to claim 5, wherein a sequence of video signals input to the plurality of video lines at the first frame period is the same as a sequence of video signals input to the plurality of video lines at the second frame period.

* * * * *